US006968591B2

(12) United States Patent
Tanaka

(10) Patent No.: US 6,968,591 B2
(45) Date of Patent: Nov. 29, 2005

(54) CLEANING ARTICLE

(75) Inventor: Yoshinori Tanaka, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 107 days.

(21) Appl. No.: 10/257,588

(22) PCT Filed: Feb. 21, 2002

(86) PCT No.: PCT/JP02/01516

§ 371 (c)(1),
(2), (4) Date: Oct. 11, 2002

(87) PCT Pub. No.: WO02/065887

PCT Pub. Date: Aug. 29, 2002

(65) Prior Publication Data

US 2004/0016074 A1 Jan. 29, 2004

(30) Foreign Application Priority Data

Feb. 23, 2001 (JP) ..... 2001-047979

(51) Int. Cl.[7] ..... A47L 13/20
(52) U.S. Cl. ..... 15/229.1; 15/229.4; 15/209.1
(58) Field of Search ..... 15/229.1–229.4, 15/229.7–229, 247, 209.1; 156/308.2, 309.3, 156/308.4, 309.6; 40/314, 360, 649, 654.01

(56) References Cited

U.S. PATENT DOCUMENTS

| | | | | | |
|---|---|---|---|---|---|
| 823,725 | A | * | 6/1906 | Hayden | 15/114 |
| 1,437,145 | A | * | 11/1922 | Johnson | 15/210.1 |
| 3,525,113 | A | * | 8/1970 | Leland | 15/229.4 |
| 3,822,435 | A | * | 7/1974 | Moss | 15/229.8 |
| 5,727,277 | A | * | 3/1998 | Chien | 15/209.1 |
| 5,953,784 | A | * | 9/1999 | Suzuki et al. | 15/209.1 |
| 6,139,928 | A | * | 10/2000 | Sloot | 428/7 |

FOREIGN PATENT DOCUMENTS

| | | | |
|---|---|---|---|
| JP | 59-95969 | 6/1984 | A47L 13/16 |
| JP | 02-4541 | 1/1990 | A47L 13/10 |
| JP | 6-123034 | 5/1994 | D02G 3/44 |
| JP | 07-012069 | 2/1995 | |
| JP | 07-126971 A1 | 5/1995 | |
| JP | 9-503426 | 4/1997 | A47L 13/20 |
| JP | 10-328107 | 12/1998 | A47L 13/16 |
| JP | 11-15188 A1 | 6/1999 | |
| JP | 11-276402 A1 | 10/1999 | |
| JP | 11-350275 A1 | 12/1999 | |

* cited by examiner

*Primary Examiner*—John Kim
*Assistant Examiner*—Laura C Cole
(74) *Attorney, Agent, or Firm*—Darby & Darby

(57) ABSTRACT

Disclosed is a cleaning article to be used while being attached to a holder. The cleaning article includes: a base sheet; a brush portion provided on one side of the base sheet; and a holding sheet provided on the other side of the base sheet. The base sheet, the brush portion and the holding sheet are fusion-bonded together to have at least two fusion-bonded portions which are spaced apart from each other and define a holding space between the base sheet and the holding sheet for accommodating the holder. One of the base sheet, the brush portion and the holding sheet is provided with a color different from those of the others so that the fusion-bonded portions have a color different from that of the holding sheet.

16 Claims, 6 Drawing Sheets

CLEANING ARTICLE

BACKGROUND OF THE INVENTION

1. Field of the Invention

The present invention relates to a cleaning article which is to be used while being attached to a holder.

2. Description of the Related Art

For the conventional disposable cleaning articles for wiping a floor or the like, a sheet such as a spunlaced nonwoven fabric or a spunlaced nonwoven fabric coated with a dirt attracting agent (e.g., paraffin) has been widely used. Upon use, Such type of cleaning article is attached to a dedicated mop holder, typically, by wrapping the cleaning article around the head of the holder.

However, the conventional cleaning article of this type has not so high performance in attracting fine dirt and dust. In addition, since it is intended to be used for wiping a relatively wide, flat area, such as floor, the structure thereof is not adapted to efficiently wipe a surface of furniture, a gap between furniture, or the like. Furthermore, it is troublesome to wrapping such cleaning article around the head of the dedicated mop holder for fixation. Still furthermore, since such cleaning article is formed from white fibers, its overall color is white to be monotony.

If a holding space for accommodating a holder to be held in one hand is provided in such cleaning article, on the other hand, the cleaning article becomes suitable for wiping the surface of furniture or the like. However, if the cleaning article is formed from white materials only, it is difficult to visually perceive the open end (inlet) of the holding space from which the holder is to be inserted. Conventionally, there is no cleaning article provided with a measure for facilitating attachment to the holder. For example, Japanese Unexamined Patent Publication No. 146306/1998 discloses a cleaning article which is formed from such nonwoven fabric and is allowed to fit on the holder to be held in one hand. However, this cleaning article is constructed such that the holder may be inserted into the holding space from the edge of the cleaning article. In addition, the open end of the holding space is difficult to notice. Therefore, inconvenience is encountered in attaching the cleaning article to the holder.

SUMMARY OF THE INVENTION

The present invention has been worked out in view of the shortcoming set forth above. Therefore, it is an object of the present invention to provide a cleaning article in which a holding space for accommodating a holder can be easily recognized.

According to a first aspect of the invention, there is provided a cleaning article to be used while being attached to a holder, the cleaning article comprising: a base sheet; a brush portion provided on one side of the base sheet; and a holding sheet provided on the other side of the base sheet, the base sheet and the holding sheet being fusion-bonded together to have at least two fusion-bonded portions which are spaced apart from each other and define a holding space between the base sheet and the holding sheet for accommodating the holder, wherein the base sheet and the holding sheet are provided with mutually different colors so that the fusion-bonded portions have a color different from that of the holding sheet.

According to a second aspect of the invention, there is provided a cleaning article to be used while being attached to a holder, the cleaning article comprising: a base sheet; a brush portion provided on one side of the base sheet; and a holding sheet provided on the other side of the base sheet, the base sheet, the brush portion and the holding sheet being fusion-bonded together to have at least two fusion-bonded portions which are spaced apart from each other and define a holding space between the base sheet and the holding sheet for accommodating the holder, wherein one of the base sheet, the brush portion and the holding sheet is provided with a color different from those of the others so that the fusion-bonded portions have a color different from that of the holding sheet.

For example, the brush portion may comprise a fiber bundle layer including colored fibers, or may comprise a plurality of fiber bundle layers, of which at least one layer adjacent to the base sheet includes colored fibers. In these cases, the colored fibers are preferably bicomponent fibers of which at least one component is colored, and more preferably, the bicomponent fibers are of sheath/core structure of which at least one of the core and sheath is colored.

It is also possible that the brush portion comprises a fiber bundle layer including colored fibers and a slit sheet having a plurality of strips formed therein, or that the brush portion comprises a fiber bundle layer and a slit sheet having a plurality of strips formed therein, and the slit sheet is formed from a nonwoven fabric including colored fibers.

In the above, the base sheet may be formed from a nonwoven fabric including white fibers or colored fibers. On the other hand, the holding sheet may be formed from a nonwoven fabric including white fibers.

According to a third aspect of the present invention, there is provided a cleaning article to be used while being attached to a holder, the cleaning article comprising: a base sheet; a brush portion provided on one side of the base sheet; and a holding sheet provided on the other side of the base sheet, the base sheet and the holding sheet being joined together to have at least two join portions which are spaced apart from each other and define a holding space between the base sheet and the holding sheet for accommodating the holder, wherein the base sheet and the holding sheet are provided with mutually different colors.

For example, the base sheet and the holding sheet are nonwoven fabrics, and at least one of the base sheet and the holding sheet comprises colored fibers.

Alternatively, at least a portion of the brush portion adjacent to the base sheet may comprise a colored material, and the base sheet may comprise a material through which the color of the colored material for the brush portion is visible so that the base sheet and the holding sheet are provided with mutually different colors.

In the third aspect of the invention, too, the join portions may be formed by fusion-bonding the base sheet and the holding sheet to each other to have a different color from that of the holding sheet.

In the first, second and third aspects of the present invention, it is preferred that an open end of the holding space, which is defined by an end portion of the holding sheet, is located inside of a corresponding end portion of the base sheet. This makes it easy to attach the cleaning article to the holder. It is more preferred that an end portion of the holding sheet defining an open end of the holding space is folded back to have a layered structure.

With the construction of the foregoing first, second and third aspects of the present invention, the position from which the holder is to be inserted and/or the direction along which the holder is to be inserted may be easily and visually perceived to facilitate and ensure insertion of the holder. Furthermore, the cleaning article may have a much better appearance.

BRIEF DESCRIPTION OF THE DRAWINGS

The present invention will be understood more fully from the detailed description given hereinafter and from the accompanying drawings of the preferred embodiments of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiments of a cleaning article according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscurity of the present invention.

The term "colored" as used herein is meant to indicate that a material comprises a pigment or dye to have a color other than white.

The term "white fiber" as used herein refers to a fiber which does not comprise any pigment or dye for coloring, except for whitening agent such as titanium oxide.

Figure 1:
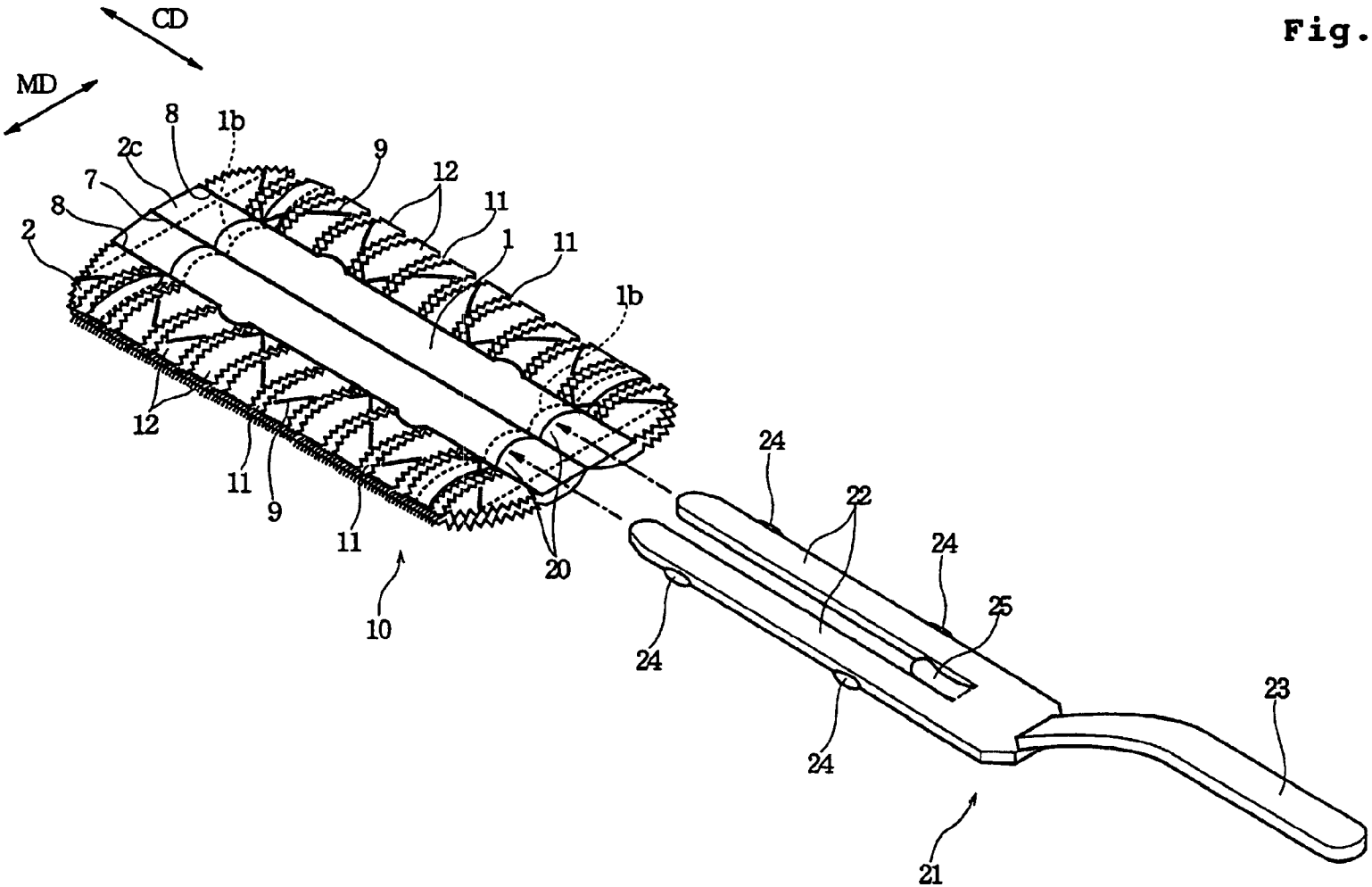
FIG. 1 is a perspective view showing a cleaning article according to a first embodiment of the present invention.
Figure 2:
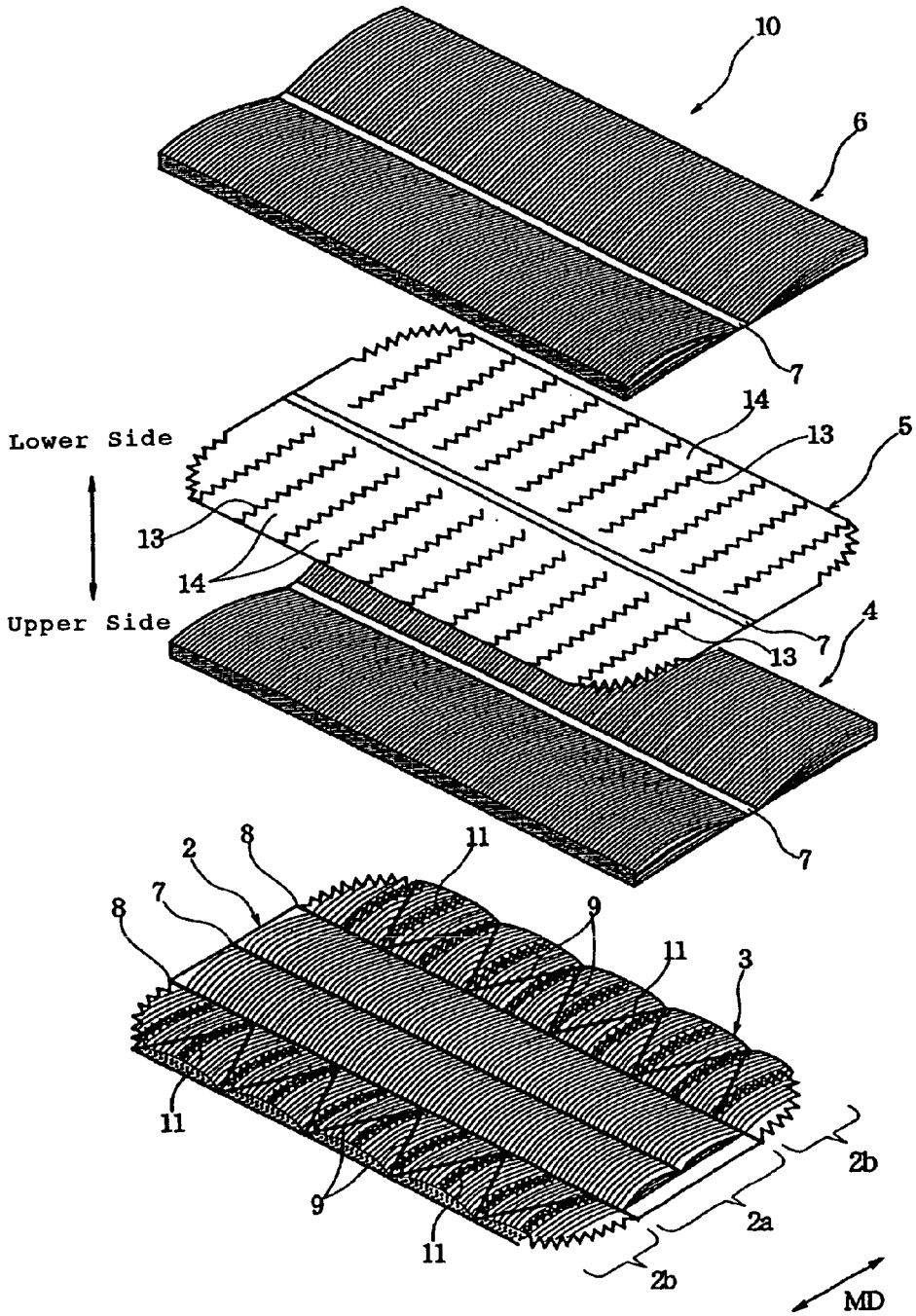
FIG. 2 is an exploded perspective view showing individual layers forming the cleaning article of FIG. 1 in upside down form.

FIG. 1 is a perspective view of a cleaning article 10 according to a first embodiment of the present invention, and FIG. 2 is an exploded perspective view of the cleaning article 10 for illustrating individual layers in upside down form.

The cleaning article 10, shown in FIG. 1, is formed by stacking a holding sheet 1, a base sheet 2, a first fiber bundle layer 3, a second fiber bundle layer 4, a slit sheet 5 having a plurality of strips formed therein, and a third fiber bundle layer 6 in sequential order from the upper side to the lower side of the article 10. The first fiber bundle layer 3, the second fiber bundle layer 4, the slit sheet 5 and the third fiber bundle layer 6 are combined to form a brush portion for capturing dust.

In the drawings, MD refers to a flow direction of the cleaning article 10 on the production line, along which the shorter sides of the cleaning article 10 extend. The holding sheet 1, the base sheet 2 and the slit sheet 5 are formed from a disposable material, such as a nonwoven fabric formed from thermoplastic fibers (heat-fusible fibers) only or containing thermoplastic fibers. The thermoplastic fibers may be monocomponent fibers of PE (polyethylene), PP (polypropylene) or PET (polyethylene terephthalate), or bicomponent fibers of PE and PET or PE and PP (e.g., sheath/core bicomponent fibers of which the core is PET or PP and the sheath is PE). The nonwoven fabric may be a thermal bonded non-woven fabric, spunbonded non-woven fabric, through-air bonded non-woven, spunlaced non-woven fabric or the like. In the alternative, the holding sheet 1, the base sheet 2 and the slit sheet 5 may be formed from a thermoplastic resin film, such as PE film or PP film. In the further alternative, the holding sheet 1, the base sheet 2 and the slit sheet 5 may be a laminated sheet of a nonwoven fabric and a resin film.

The first fiber bundle layer 3, the second fiber bundle layer 4 and the third fiber bundle layer 6 are individually formed from a bundle of thermoplastic fibers or a bundle of fibers in which thermoplastic fibers are blended with other fibers. In this embodiment, each fiber bundle layer is formed by opening (debundlizing) a tow of filaments to have uniform bulkiness in CD, and cutting the opened tow so that individual cut filaments extend over the entire width of the fiber bundle layer. The filaments may be made of PE, PP, PET, Ne (nylon), rayon or combination thereof. Amongst, it is preferred to use sheath/core bicomponent fibers of which the core is PP or PET and the sheath is PE.

In the shown embodiment, the first fiber bundle layer 3, the second fiber bundle layer 4 and the third fiber bundle layer 6 are provided with color or colors different from those of the materials of the holding sheet 1, the base sheet 2 and the slit sheet 5. For example, the holding sheet 1, the base sheet 2 and the slit sheet 5 are all formed from a nonwoven fabric of white fibers, or a resin film containing whitening agent; the first fiber bundle layer 3, the second fiber bundle layer 4 and the third fiber bundle layer 6 are all formed from a material colored in blue. In case where the fiber bundle layers 3, 4 and 6 are formed from sheath/core bicomponent fibers, for example, it is preferred that only one of the core and sheath is colored so that the fiber bundle layer may assume watery blue for good appearance. However, it is, of course, possible to color both of the core and sheath. When the fiber bundle layers are formed from colored fibers, the cleaning article 10 can provide voluminous appearance in comparison with the case where the fiber bundle layers are formed from white fibers. In addition, when the fiber bundle layers are entangled together or twisted to be one-sided upon cleaning, such condition can be visually and readily perceived to easily find timing of disposal.

A coloring method for the fibers (e.g., sheath/core bicomponent fibers) may be mass-coloring performed by preliminarily blending pigment or dye to a resin material prior to spinning. Alternatively, a dye or the like may be applied to the surface of the fiber bundle layer. Here, mass-coloring is preferred for avoiding color migration to cleaning object. Of course, the color of the fiber bundle layer should not be limited to blue, but may be red or any desirable color. If only one component of bicomponent fibers is colored in red, for example, the resulting fiber bundle layer will assume light shade of pink to have good appearance.

Fineness of the filaments for forming the fiber bundle layer is preferably 1 to 50 dtex, and more preferably 2 to 10 dtex. Here, the fineness may vary between fiber bundle layers.

The fibers forming the fiber bundle layer are preferably crimped. If crimped, the resulting fiber bundle layer is increased in bulkiness to have a structure easily accommodating dust and dirt in the crimped portion. Particularly preferably, the fiber bundle layer is formed from a tow of crimped filaments.

Alternatively, the fiber bundle layer may be formed from flat yarns or split yarns, in place of the foregoing fibers. The flat yarns are prepared by slitting a film into tapes and stretching the tapes in the longitudinal direction thereof. The split yarns are prepared by splitting a thermoplastic film in a direction perpendicular to the orientation direction of the resin so that the film is fibrillated and interconnected into a net shape. In this case, by adding a pigment or dye to the resin material upon forming the film, the resulting flat yarns or split yarns can be colored. In the alternative, a dye or the like may be applied to the surface of the film for coloring. Here, the fiber bundle layer may be replaced by a bulky nonwoven fabric having a low fiber density such as through-air bonded nonwoven fabric.

Next, discussion will be given for the layered structure of the cleaning article 10.

On the upper face of the base sheet 2, there is stacked the holding sheet 1. A dimension of the holding sheet 1 in a direction perpendicular to MD (CD: longitudinal direction of the cleaning article 10) is shorter than that of the base sheet 2. On the other hand, the width dimensions of both the holding sheet 1 and the base sheet 2 in MD match with each other. Here, the front and rear end portions of the holding sheet 1 are individually folded back against the lower face of the holding sheet 1, thereby forming folded portions (layered portions) 1*b* and 1*b*. Similarly, the front and rear end portions of base sheet 2 are individually folded back, thereby forming folded portions (layered portions) 2*c* and 2*c*.

On the lower face of the base sheet 2, the first fiber bundle layer 3 having uniform bulkiness in CD is stacked with its constituent fibers being oriented along MD. The holding sheet 1, the base sheet 2 and the first fiber bundle layer 3 are joined together at two parallel join lines 8, 8 and (if desired) at a plurality of side join lines 9 extending obliquely outside of the join lines 8, 8. The joining is performed by heat-sealing, ultrasonic sealing or the like, so that the holding sheet 1, the base sheet 2 and the first fiber bundle layer 3 are fusion-bonded together at the join lines 8 and 9. It should be noted that the side join lines 9 are not essential and can be eliminated.

After the holding sheet 1, the base sheet 2 and the first fiber bundle layer 3 are thus stacked and joined together, moreover, there are formed zigzag (saw tooth like) cut-lines 11, to thereby form a plurality of thin strips 12 respectively separated by the cut-lines 11 in the holding sheet 1 and the base sheet 2. These thin strips 12 are formed in side regions 2*b*, 2*b*, each of which is located between one join line 8 and adjacent one of side edges of the laminate. On the other hand, the numeral 2*a* indicates a holding region (center region) which is located between the two join lines 8, 8. In the holding region 2*a*, the base sheet 2 and the holding sheet 1 are stacked without the strips 12.

On the lower face of the first fiber bundle layer 3, moreover, the second fiber bundle layer 4, the slit sheet 5 and the third fiber bundle layer 6 are stacked in sequential order. Both the second fiber bundle layer 4 and the third fiber bundle layer 6 have uniform bulkiness in CD with their constituent fibers being oriented along MD. On the other hand, the slit sheet 5 is formed with zigzag (saw tooth like) cut-lines 13 to have a plurality of thin strips 14 respectively separated by the cut-lines 13. Each thin strip 14 extends along MD.

After all the layers (the holding sheet 1, the base sheet 2, the first fiber bundle layer 3, the second fiber bundle layer 4, the slit sheet 5 and the third fiber bundle layer 6) are thus stacked, they are joined together at an all-layer join line 7 which extends along a longitudinally extending centerline of the article 10. This all-layer join line 7 is located at the midpoint between the two join lines 8, 8 and extends in parallel to the join lines 8, 8. The all-layer join line 7 is formed by fusion-bonding (e.g., heat-sealing or ultrasonic sealing).

Here, it should be noted that the layered structure of this embodiment can be modified variously. For example, the slit sheet 5 may appear on the lower face of the article 10 in place of the third fiber bundle layer 6, by omitting the third fiber bundle layer 6 or by stacking the slit sheet 5 below the third fiber bundle layer 6. It is also possible to form the zigzag cut-lines 11 after the holding sheet 1 and base sheet 2 are stacked but before the first fiber bundle layer 3 is stacked and the join lines 8, 8 are formed. In this case, moreover, the second fiber bundle layer 4 may also be joined at the join lines 8, 8 so that the holding sheet 1, the base sheet 2, the first fiber bundle layer 3 and the second fiber bundle layer 4 are joined together at the join lines 8, 8.

The cleaning article 10 thus constructed can effectively capture dust by the brush portion comprising the fiber bundle layers and the slit sheet. Particularly, the strips of the slit sheet are effective in wiping off relatively large dust such as crumb; and the fiber bundle layers are effective in capturing dust.

On the other hand, the holding sheet 1 and the base sheet 2 appearing on the upper face (see FIG. 1) of the cleaning article 10 thus constructed are joined to each other at three fusion-bonded portions (i.e., the join lines 8, 8 and the all-layer join line 7), providing two holding spaces 20, 20 for accommodating a holder 21 which will be discussed later. Specifically, each holding space 20 between the holding sheet 1 and the base sheet 2 is defined between the all-layer join line 7 and one of the join lines 8.

Here, as set forth above, the holding sheet 1 and the base sheet 2 are formed in white and the fiber bundle layers 3, 4 and 6 are individually formed from colored fibers. In addition, the join lines 8, 8 are formed by fusion-bonding the holding sheet 1, the base sheet 2 and the first fiber bundle layer 3 together to be filmy. Therefore, the join lines 8, 8 assume the same color as that of the first fiber bundle layer 3 (e.g., blue) so that the join lines 8, 8 may have different color from that of the material for the holding sheet 1 to be clearly and visually distinguished. Similarly, because the all-layer join line 7 is formed by fusion-bonding all the layers (including the colored three fiber bundle layers 3, 4 and 6) together to be filmy, the all-layer join line 7 assumes the color (e.g., blue) different from that of the material for the holding sheet 1.

Accordingly, as viewed from the above as illustrated in FIG. 1, the all-layer join line 7 and the join lines 8, 8 stand out clearly. As a result, the holding spaces 20, 20 each defined between adjacent fusion-bonded portions can be clearly and visually distinguished.

Here, it is preferred that the color of the first fiber bundle layer 3 can also be seen through the remaining portion (the portion other than the join lines 7 and 8) of the overlying base sheet 2. This can be achieved by preparing the base sheet 2 from a nonwoven fabric or film to be white and to have such a basis weight as to permit some degree of light transmission. In this case, since the holding sheet 1 is stacked on the base sheet 2, even if the holding sheet 1 overlying the base sheet 2 also has some degree of light transmission, the color of the first fiber bundle layer 3 seen through the remaining portion (the portion other than the join lines 7 and 8) of the holding sheet 1 becomes paler than the color seen through the base sheet 2 only. Accordingly, as viewed from the above as illustrated in FIG. 1, the base sheet 2 and the holding sheet 1 are different in color tone from each other to thereby make the front and rear edges of the holding sheet 1 noticeable. Moreover, since these front and rear edges are formed by folding back the holding sheet 1 to have the folded portions (layered portions) 1*b* and 1*b*, as set forth, the color of the first fiber bundle layer 3 seen through the folded portions 1*b* and 1*b* becomes much paler. Since these folded portions 1*b* and 1*b* are located at the open ends of the holding spaces 20 and 20, the open ends of the holding spaces 20 and 20 can be visually and clearly distinguished.

In order that the color of the underlying fiber bundle layer can be seen through the remaining portion of the base sheet 2, it is preferred that the base sheet 2 has a light transmittance greater than or equal to 80% (as measured based on JIS-K-7105). It is further preferred that a difference between the light transmittance of the base sheet 2 alone and the light transmittance of the stack of the holding sheet 1 and the base sheet 2 is greater than or equal to 10%.

In this embodiment, as has been described hereinabove, all the fiber bundle layers 3, 4 and 6 are colored. However, the fusion-bonded portions (i.e., the join lines 8, 8 and the all-layer join lines 7) can assume the color as long as at least one of the first fiber bundle layer 3, the second fiber bundle layer 4, the slit sheet 5 and the third fiber bundle layer 6 is colored. For example, it is also possible that the slit sheet 5 is formed from a colored material and all the fiber bundle layers 3, 4 and 6 are formed from white fibers. However, it is preferred that at least the first fiber bundle layer 3 located adjacent the base sheet 2 is colored in order to make the color of the lower layer visible through the remaining portion of the base sheet 2. In the alternative, the base sheet 2 may be colored.

For making the base sheet 2 and/or the slit sheet 5 as colored sheets, these sheets may be formed from a nonwoven fabric comprising colored fibers or a resin film containing a pigment or dye. On the other hand, the holding sheet 1 is preferably white. However, the holding sheet 1 may be colored in the extent that can be distinguished from the color of the join lines 8 and the all-layer join line 7.

It should be noted that the nonwoven fabric for the base sheet 2 and/or the slit sheet 5 is not necessarily formed from the colored fibers entirely (100%), but the colored fibers may be partly admixed to form a colored nonwoven fabric as a whole. Similar is true even when the holding sheet 1 is formed from a nonwoven fabric comprising colored fibers.

In order to make the color of the lower layer visible through the colored base sheet 2, at least the first fiber bundle layer 3 located adjacent the base sheet 2 should be colored.

As shown in FIG. 1, the upper side of the cleaning article 10 can be attached to the holder 21. The holder 21 has bifurcated inserting portions 22, 22 and a hand grip portion 23. The inserting portions 22, 22 are arranged in spaced apart relationship. Each inserting portion 22 is provided at its one side face with two engaging projections 24. Moreover, an engaging strip 25 extending toward the tip end of the holder 21 is integrally formed in a base end portion from which the inserting portions 22, 22 extend.

In the cleaning article 10, the all-layer join line 7 and the join lines 8, 8 are clearly colored, and, in addition, the holding sheet 1 and the base sheet 2 appear to be different in color tone. Therefore, the position from which the holder 21 is to be inserted and the direction along which the holder 21 is to be inserted can be easily perceived. Moreover, since the folded portions (layered portions) 1*b* and 1*b* located at the open ends of the holding spaces 20 and 20 can be visually perceived as being different from the remaining portion, it becomes easy to find the open ends of the holding spaces 20 and 20 for accommodating the holder 21. This results in easy insertion of the bifurcated inserting portions 22 and 22 into the holding spaces 20 and 20. Still moreover, the open ends are located inside of the end edges of the base sheet 2, so that the inserting portions 22 and 22 can be easily slid into the holding spaces 20 and 20 through the open ends.

When the inserting portions 22 and 22 are inserted into the holding spaces 20 and 20, the engaging strip 25 is placed on the all-layer join line 7 to clamp the holding sheet 1 between the inserting portions 22, 22 and the engaging strip 25 for preventing the cleaning article 10 from slipping off the holder 21.

Moreover, since the cleaning article 10 is formed in symmetric shape relative to the centerline extending in MD, as shown in FIGS. 1 and 2, the inserting portions 22, 22 of the holder 21 can be inserted into the holding spaces 20, 20 from either end thereof. Therefore, after the holder 21 is attached to the cleaning article 10 from the direction of FIG. 1 and then locally soiled by cleaning operation, it is possible to attach the holder 21 to the cleaning article 10 from the opposite direction. By changing the orientation of the cleaning article 10 as described above, the brush portion of the cleaning article 10 can be fully and uniformly exploited for cleaning operation.

Figure 6:
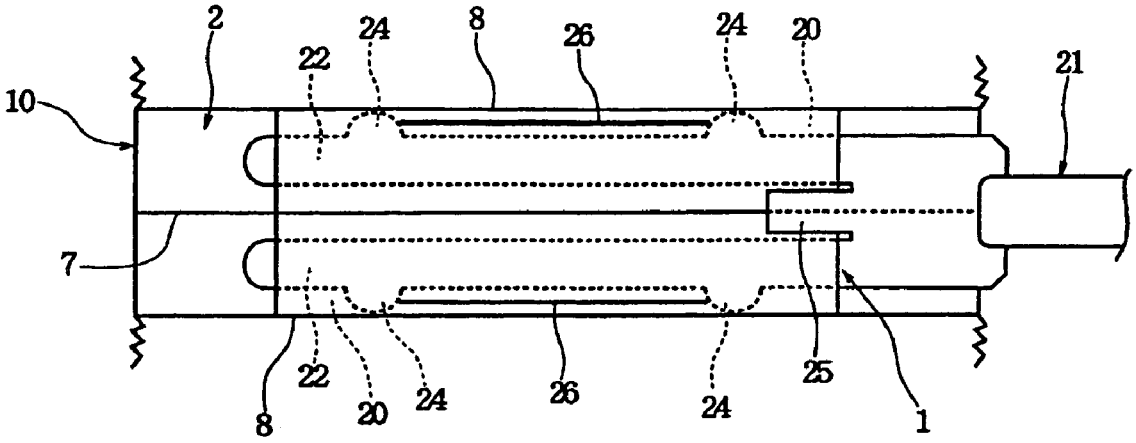
FIG. 6 is a plan view showing a modification of the cleaning article of FIG. 1.

Here, as shown in FIG. 6, the cleaning article may further be provided with additional short join lines 26, 26 where the holding sheet 1 and the base sheet 2 are joined. These join lines 26, 26 are located within the holding region 2*a* defined between the join lines 8, 8. Each join line 26 is formed to have a length substantially equal to the interval between the engaging projections 24, 24 of each inserting portion 22. When the inserting portions 22, 22 are inserted into the holding spaces 20, 20, therefore, the cleaning article 10 is prevented from slipping off the holder 21 by placing each join line 26 between the engaging projections 24, 24 of each inserting portion 22.

Figure 3:
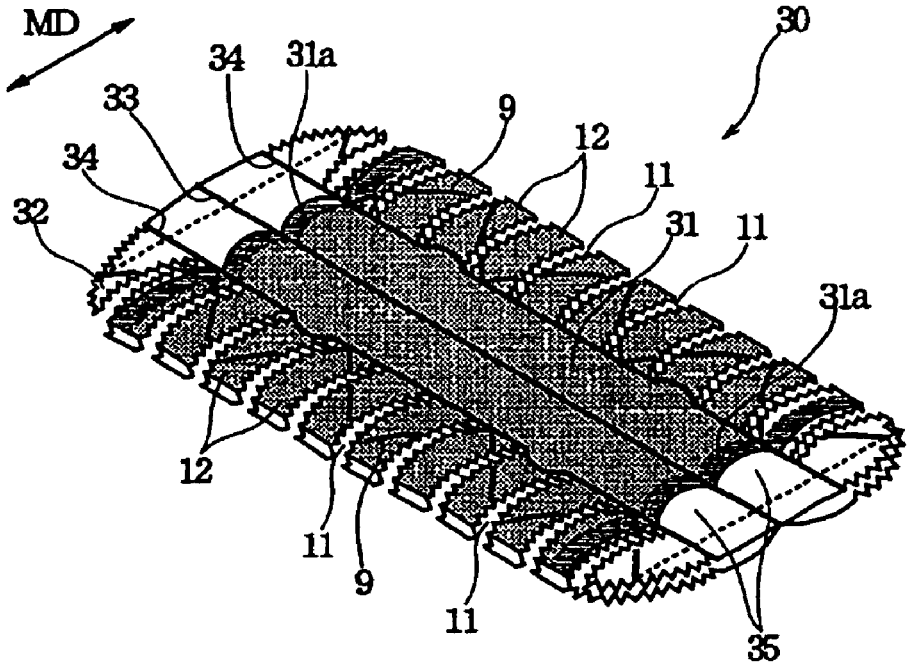
FIG. 3 is a perspective view showing a cleaning article according to a second embodiment of the present invention.

FIG. 3 is a perspective view showing a cleaning article 30 according to a second embodiment of the present invention.

The cleaning article 30 has a layered structure of sheets and fiber bundle layers similar to that of the cleaning article 10. The difference from the first embodiment is that a holding sheet 31 and a base sheet 32 have different colors from each other.

In the cleaning article 30 shown in FIG. 3, the holding sheet 31 is colored in blue or other color, and all of other layers including the base sheet 32 are formed from white materials. The cleaning article 30 is constructed such that all the layers are joined together at an all-layer join line 33, and the holding sheet 31, the base sheet 32 and the first fiber bundle layer are joined together at two join lines 34, 34, as in the cleaning article 10. The all-layer join line 33 and the join lines 34, 34 may be formed by fusion-bonding such as heat-sealing, ultrasonic sealing or the like. Alternatively, they may be formed by applying an adhesive or by sewing.

In the cleaning article 30, two holding spaces 35 are defined by the join lines 34, 34 and the all-layer join line 33 between the holding sheet 31 and the base sheet 32. Into these holding spaces 35, 35, the inserting portions 22, 22 of the holder 21 are inserted as shown in FIG. 1.

In the cleaning article 30 thus described, since the holding sheet 31 and the base sheet 32 are provided with different colors, the open ends of the holding spaces 35, 35 into which the inserting portions 22, 22 of the holder 21 are to be inserted, can be easily and visually perceived.

In the alternative, it is possible to provide the holding sheet 31 in white and to form the base sheet 32 from a colored material. Furthermore, it is also possible to color the holding sheet 31 and the base sheet 32 in different colors.

On the other hand, it is further possible to form the base sheet 32 from a material having some degree of light transmission and to form the first fiber bundle layer located below the base sheet 32 from a colored material so that the color of the first fiber bundle layer below the base sheet 32 can be visible through the base sheet 32 as viewed from the above, and to form the holding sheet 31 from a material of color different from the color viewed through the base sheet 32.

Even in this case, it is preferred that at least one layer (i.e., one of the fiber bundle layers or the slit sheet) forming the brush portion is formed from a colored material and that the all-layer join line 33 and the join lines 34, 34 are formed by fusion-bonding. This results in coloring the join lines 33, 34 and 34 so that the position of the holding spaces 35, 35 can be easily perceived.

Moreover, the holding sheet 31 is provided at its front and rear end portions with folded portions (layered portions) 31*a*, 31*a*, similar to the folded portions (layered portions) 1*b*, 1*b* of the cleaning article 10. When the holding sheet 31 is colored, the folded portions 31*a*, 31*a* may have deeper color than the remaining portion of the holding sheet 31 to facilitate recognition of the open ends of the holding spaces 35, 35. On the other hand, even when the holding sheet 31 is formed from a white material and the base sheet 32 is formed from a colored material, the folded portions 31*a*, 31*a* facilitates recognition of the open ends of the holding spaces 35, 35. This is because the transmittance of color through the folded portions 31*a*, 31*a* becomes lower than that of the remaining portion of the holding sheet 31.

Figure 4:
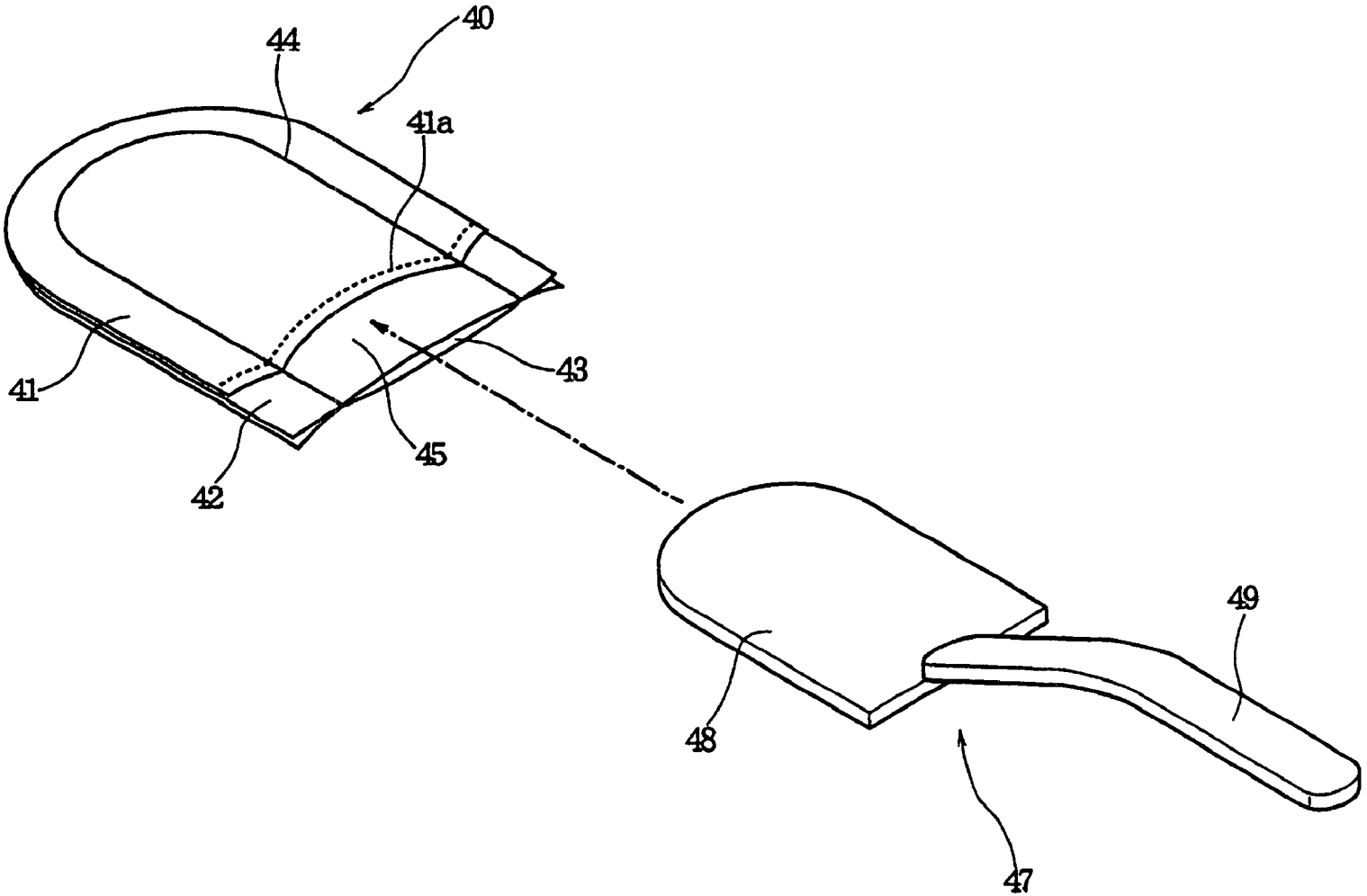
FIG. 4 is a perspective view showing a cleaning article according to a third embodiment of the present invention.

FIG. 4 is a perspective view showing a cleaning article 40 according to a third embodiment of the present invention.

The cleaning article 40 is formed by stacking a holding sheet 41 on the upper face of a base sheet 42, and stacking a brush portion 43 on the lower face of the base sheet 42. This brush portion 43 is formed from a fiber bundle layer only, a nonwoven fabric only or combination thereof. In this embodiment, at least a part of the brush portion 43 is formed from a material colored in blue or the like, and the holding sheet 41 and the base sheet 42 are formed from white materials. Then, the holding sheet 41, the base sheet 42 and the brush portion 43 are stacked and joined together at the peripheral portion of the stack by heat-sealing, ultrasonic sealing or the like, thereby forming an all-layer join line 44. Thus, a holding space 45 is defined between the holding sheet 41 and the base sheet and inside of the all-layer join line 44.

As shown in FIG. 4, a holder 47 is attached to the cleaning article 40. Specifically, the holder 47 includes a flat inserting portion 48 and a hand grip portion 49 formed integrally with the inserting portion 48, and the inserting portion 48 is inserted into the holding space 45.

In the cleaning article 40, since the brush portion 43 is formed from the material colored in blue or the like, the all-layer join line 44, which is a fusion-bonded portion where the individual layers are fusion-bonded together to be filmy, is colored. Therefore, the all-layer join line 44 is differentiated in color from the holding sheet 41 and the base sheet 42 formed from white materials, to thereby facilitate recognition of the position from which the holder 47 is to be inserted and the direction along which the holder 47 is to be inserted. Since at least a part of the brush portion 43 is colored, moreover, the brush portion 43 can provide voluminous appearance. Even in this case, the holding sheet 41 is preferably formed with a folded portion (layered portion) 41*a* at the open end of the holding space 45.

Even in this embodiment, it is possible to form the base sheet 42 from a colored material and to form the holding sheet 41 from a white material so that the all-layer join line 44 can be colored.

On the other hand, it is also possible to form the holding sheet 41 and the base sheet 42 from materials colored in different colors to facilitate recognition of the open end of the holding space 45.

Figure 5:
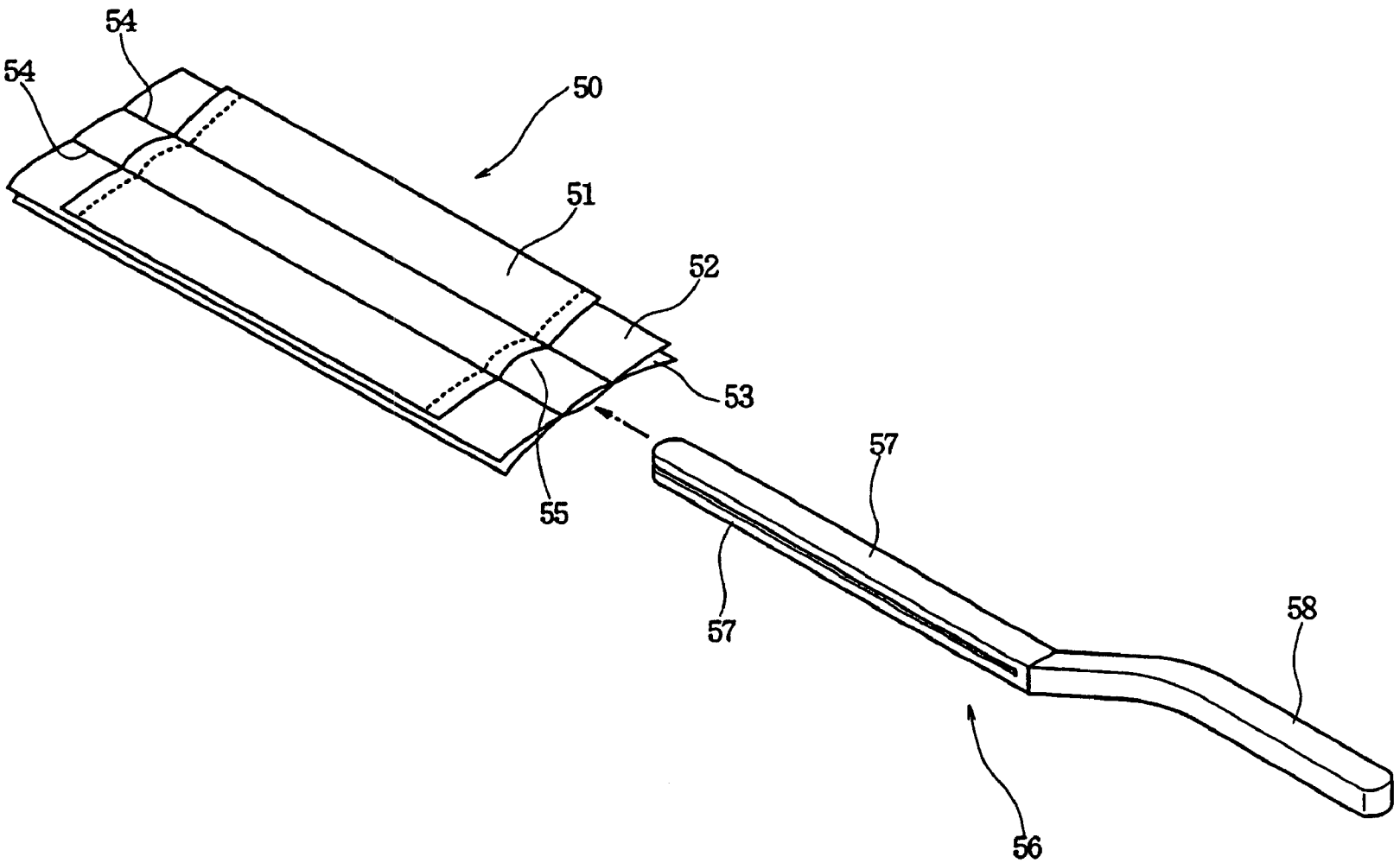
FIG. 5 is a perspective view showing a cleaning article according to a fourth embodiment of the present invention.

FIG. 5 is a perspective view showing a cleaning article 50 according to a fourth embodiment of the present invention.

The cleaning article 50 shown in FIG. 5 is formed by stacking a holding sheet 51 on the upper face of a base sheet 52, and stacking a brush portion 53 on the lower face of the base sheet 52. The brush portion 53 may be formed mainly from a nonwoven fabric or may be formed only from a fiber bundle layer formed by opening a tow. The holding sheet 51, the base sheet 52 and the brush portion 53 thus stacked are fusion-bonded together to form all-layer join lines 54, 54 for defining a holding space 55. In this embodiment, too, the brush portion 53 is formed from a colored material, or the holding sheet 51 and the base sheet 52 are formed from materials colored in different colors.

The holding space 55 accommodates a holder 56. The holder 56 has bifurcated, upper and lower inserting portions 57, 57 and a hand grip portion 58. These inserting portions 57, 57 are arranged with a small gap so that the holding sheet 51 may be clamped between the upper and lower inserting portions 57, 57 by inserting the lower inserting portion 57 into the holding space 55.

Although the present invention has been illustrated and described with respect to exemplary embodiments thereof, it should be understood by those skilled in the art that the foregoing and various other changes, omission and additions may be made therein and thereto, without departing from the spirit and scope of the present invention. Therefore, the present invention should not be understood as limited to the specific embodiments set out above but to include all possible embodiments which can be embodied within a scope encompassed and equivalent thereof with respect to the feature set out in the appended claims.

For instance, it is possible to join a plurality of strip form holding sheets on the surface of the base sheet to define the holding space for accommodating the holder between respective strip form holding sheets and the base sheet. Even in this case, recognition of the holding space can be facilitated by providing different colors for the holding sheets and the base sheet.

On the other hand, it is also possible to join another fiber bundle layer on the surface of the holding sheet in the extent that the holding space can be recognized.

What is claimed is:

1. A cleaning article to be used while being attached to a holder, the cleaning article comprising: a base sheet; a brush portion provided on one side of the base sheet; and a holding sheet provided on the other side of the base sheet, the base sheet and the holding sheet being fusion-bonded together to have at least two fusion-bonded portions which are spaced apart from each other and define a holding space between the base sheet and the holding sheet for accommodating the holder, wherein the base sheet and the holding sheet are provided with mutually different colors so that the fusion-bonded portions have a color different from that of the holding sheet.

2. A cleaning article as set forth in claim 1, wherein the brush portion comprises a fiber bundle layer including colored fibers.

3. A cleaning article as set forth in claim 2, wherein the colored fibers are bicomponent fibers of which at least one component is colored.

4. A cleaning article as set forth in claim 3, wherein the bicomponent fibers are of sheath/core structure of which at least one of the core and sheath is colored.

5. A cleaning article as set forth in claim 1, wherein the brush portion comprises a plurality of fiber bundle layers, of which at least one layer adjacent to the base sheet includes colored fiber.

6. A cleaning article as set forth in claim 5, wherein the colored fibers are bicomponent fibers of which at least one component is colored.

7. A cleaning article as set forth in claim 1, wherein the brush portion comprises a fiber bundle layer including colored fibers and a slit sheet having a plurality of strips formed therein.

8. A cleaning article as set forth in claim 1, wherein the brush portion comprises a fiber bundle layer and a slit sheet having a plurality of strips formed therein, and the slit sheet is formed from a nonwoven fabric including colored fibers.

9. A cleaning article as set forth in claim 1, wherein the base sheet is formed from a nonwoven fabric including white fibers.

10. A cleaning article as set forth in claim 1, wherein the base sheet is formed from a nonwoven fabric including colored fibers.

11. A cleaning article as set forth in claim 1, wherein the holding sheet is formed from a nonwoven fabric including white fibers.

12. A cleaning article to be used while being attached to a holder, the cleaning article comprising: a base sheet; a brush portion provided on one side of the base sheet; and a holding sheet provided on the other side of the base sheet, the base sheet, the brush portion and the holding sheet being fusion-bonded together to have at least two fusion-bonded portions which are spaced apart from each other and define a holding space between the base sheet and the holding sheet for accommodating the holder, wherein one of the base sheet, the brush portion and the holding sheet is provided with a color different from those of the others so that the fusion-bonded portions have a color different from that of the holding sheet.

13. A cleaning article as set forth in claim 2, wherein the brush portion comprises a fiber bundle layer including colored fibers.

14. A cleaning article as set forth in claim 2, wherein the brush portion comprises a plurality of fiber bundle layers, of which at least one layer adjacent to the base sheet includes colored fibers.

15. A cleaning article as set forth in claim 2, wherein the brush portion comprises a fiber bundle layer including colored fibers and a slit sheet having a plurality of strips formed therein.

16. A cleaning article as set forth in claim 2, wherein the brush portion comprises a fiber bundle layer and a slit sheet having a plurality of strips formed therein, and the slit sheet is formed from a nonwoven fabric including colored fibers.

* * * * *